United States Patent [19]

McDonie

[11] 4,039,887

[45] Aug. 2, 1977

[54] ELECTRON EMITTER INCLUDING POROUS ANTIMONY

[75] Inventor: Arthur Frederick McDonie, Lancaster, Pa.

[73] Assignee: RCA Corporation, New York, N.Y.

[21] Appl. No.: 583,745

[22] Filed: June 4, 1975

[51] Int. Cl.[2] ..... H01J 1/14; H01J 19/06

[52] U.S. Cl. ..... 313/346 R; 313/94; 313/95; 313/386; 313/379; 427/74; 427/77

[58] Field of Search ..... 313/346, 94, 95, 103, 313/385, 386, 337, 384, 379; 427/74, 77, 78

[56] References Cited

U.S. PATENT DOCUMENTS

| | | | |
|---|---|---|---|
| 2,242,395 | 5/1941 | Hartmann et al. | 427/78 |
| 2,967,254 | 1/1961 | Forgue | 313/386 |
| 3,106,488 | 10/1963 | Lubszynski | 313/385 X |
| 3,315,108 | 4/1967 | Heagy | 313/386 |
| 3,372,294 | 3/1958 | Fisher | 313/385 |
| 3,546,514 | 12/1970 | Blamoutier | 313/103 |
| 3,657,596 | 4/1972 | Goetze | 313/95 |
| 3,697,794 | 10/1972 | Stoudenheimer et al. | 427/74 |
| 3,890,524 | 6/1975 | Watanabe et al. | 313/94 |

*Primary Examiner*—Saxfield Chatmon, Jr.
*Attorney, Agent, or Firm*—Glenn H. Bruestle; Robert J. Boivin; William L. Muckelroy

[57] ABSTRACT

A reflective type photocathode of a photomultiplier includes a porous antimony layer in overlay relation to a layer of solid antimony along a supporting substrate.

5 Claims, 3 Drawing Figures

ELECTRON EMITTER INCLUDING POROUS ANTIMONY

BACKGROUND OF THE INVENTION

The invention relates to electron emitters and more particularly to electron emissive materials suitable for use in such structures.

Electron emissive materials are particularly useful for incorporation in detection devices such as, for example, photomultiplier tubes, image tubes, and image intensifier tubes, as photocathodes or secondary emissive electrode materials. The operation and construction of such detection devices is well known in the art of electron discharge devices.

Numerous electron emissive materials and electron emitters including such materials have been developed which are suitable for photocathodes and/or secondary emissive electrodes. Among such materials or emitters are, for example, those described in the following U.S. patents relating to photocathodes and their manufacture:

U.S. Pat. No. 2,676,282 issued to J. J. Polkosky on Apr. 20, 1954;

U.S. Pat. No. 2,770,561 issued to A. H. Sommer on Nov. 13, 1956;

U.S. Pat. No. 2,880,344 issued to R. G. Stoudenheimer on Mar. 31, 1959;

U.S. Pat. No. 2,914,690 issued to A. H. Sommer on Nov. 24, 1959

U.S. Pat. No. 3,697,794 issued to R. G. Stoudenheimer on Oct. 10, 1972;

U.S. Pat. No. 3,372,967 issued to F. R. Hughes on Mar. 12, 1968;

U.S. Pat. No. 3,658,400 issued to F. A. Helvy on Apr. 25, 1972; and

U.S. Pat. No. 3,838,304, issued to A. F. McDonie on Sept. 24, 1974.

Electron emissive materials and electron emitters including such materials have also been developed which relate specifically to secondary emissive electrodes and their manufacture and are, for example, further described in the following U.S. patents:

U.S. Pat. No. 2,881,343 issued to J. J. Polkosky et al. on Apr. 7, 1959; and

U.S. Pat. No. 3,753,023 issued to A. H. Sommer on Aug. 14, 1973.

As indicated in the above-noted patents, the manufacture of electron emitters is a highly developed art in which a considerable effort has been exerted to increase the sensitivity of the known electron emissive materials and to provide desired spectral response characteristics. Typically, base layers of solid antimony which have been sensitized or activated with the vapors of cesium, and/or one or more additional alkali metals have been widely used in electron emitters.

SUMMARY OF THE INVENTION

An electron emissive electrode includes a layer of porous antimony in combination with a layer of solid antimony. The electrode may be a photocathode or dynode electrode.

DESCRIPTION OF THE PREFERRED EMBODIMENTS

Figure 1:
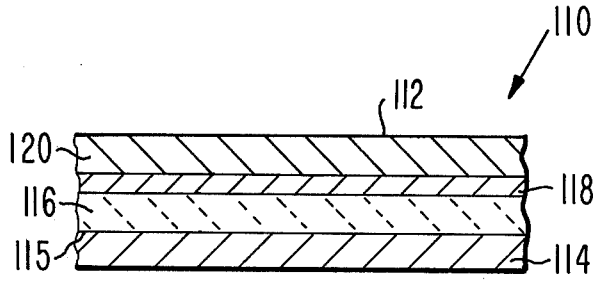
FIGS. 1–3 are non-scale greatly exaggerated cross-sectional cutaway views of alternative electron emissive electrodes in accordance with the invention.

Referring to FIG. 1, an electron emitter 110 suitable for use as a photocathode is shown. The emitter 110 is of the reflective type (i.e. electron emission from the operative photocathode occurs from the same major surface 112 upon which an input radiation signal impinges).

Emitter 110 is multilayered and is preferably formed along a major surface 115 of a supporting substrate 114. The substrate surface 115 may be planar or shaped to provide a desired electrode curvature for the application.

A thin layer of metal oxide 116 is along substrate surface 115. The emitter 110 also includes, in overlay sequence along the metal oxide layer 116: a "solid" antimony layer 118 and a "porous" antimony layer 120. The metal oxide layer 116 is provided to substantially avoid undesirable reactions of the antimony layers 118, 120 with the material of substrate 114.

In a preferred embodiment, the substrate 114 is conductive and is composed of nickel. The metal oxide in such a structure is preferably manganese oxide; however, other metal oxides such as, for example, nickel oxide may be employed to advantage. Alternatively, the material of substrate 114 may be selected to be inert with respect to antimony layers 118 and 120, in which case, the metal oxide "buffer" layer 116 may be omitted.

Antimony layers 118, 120 are referred to as "solid" or "porous", respectively. A "porous" antimony layer, as herein defined, comprises a material composition having the characteristics of one which has been, for example, evaporated in a poor vacuum, and which has a dull, smoke, or soot-like appearance in contrast to the smooth, shiny, or bright surface obtained when the same antimony material is, for example, evaporated in a higher vacuum to form solid antimony. The porous layer 120 may be, for example, described as spongy, or soft, to distinguish it from the solid layer 118 which has a hard surface. The preferred form of the porous layer 120 characteristically has a relatively homogeneous black velveteen-like appearance.

In the preferred method of fabrication of the emitter 110 as a portion of a reflective mode-type photocathode, a layer, or film, of manganese is evaporated in a vacuum at a pressure level of less than $10^{-4}$ torr and deposited along the major surface 115 of a self-supporting nickel electrode substrate 114. The thickness of the manganese layer is selected to avoid undesireable reaction of the nickel substrate with antimony layers 118, 120 later deposited. In the case of the preferred embodiment, a thickness of the manganese layer of approximately 300A is considered adequate; however, other thicknesses may be employed to advantage.

The electrode workpiece including the manganese overlayer is then placed in a suitable enclosed chamber having an oxygen atmosphere suitable for oxidizing the manganese layer. For this purpose, exposure of the nickel workpiece within an enclosed chamber having an internal oxygen pressure of about $10^3$ mm. of Hg. at a temperature of about 825° C. for a period of 10–20 seconds has been found adequate to produce the desired layer 116 of manganese oxide.

A relatively thin "solid" antimony layer 118 of less than about 1000 Angstroms thick is thereafter evaporated in a vacuum at a pressure level of less than $10^{-4}$ torr, and deposited along the available or exposed surface of the manganese oxide layer 116 previously formed. Preferably, the solid antimony layer 118 is about 200–600A thick and is vapor deposited at a pressure level of less than about $2 \times 10^{-5}$ torr.

A relatively thick porous antimony layer 120 is thereafter formed along the exposed or available surface of the layer 118. The formation of the porous layer 120 may be expeditiously accomplished, for example, by placement of the workpiece within a continually evacuated enclosed evaporation chamber preferably capable of an initial interior vacuum level at a pressure level of less than about $10^{-5}$ torr. An inert gas (i.e., a gas which does not react with the alkali metals) such as the one selected from Group VIIIA of the Periodic Table of Elements or Nitrogen, is thereafter admitted within the interior of the chamber to establish a pressure level of from about 220 to about 310 microns of Hg. within the interior of the chamber. In the preferred method, argon is introduced, or bled, into the chamber interior during evacuation to a pressure level of from about 260 to about 310 microns of Hg. The thickness of layer 120 formed preferably is about 4 microns. While the thickness of layer 120 for a reflective type photocathode is somewhat critical, other thicknesses may be employed to advantage depending upon the type of electrode desired.

The nickel electrode workpiece including the layers 116, 118, and 120 may thereafter be sensitized to achieve a desired sensitivity and spectral response by the exposure of the available major surface of the porous layer 120 to cesium and/or one or more of the alkali metals, such as, for example, potassium and sodium. Numerous activation or sensitization techniques are known for sensitizing photocathodes and/or secondary emission type materials to produce desired sensitivity and spectral response. Such sensitizing techniques and methods relating thereto are, for example, described in the aforementioned patents issued to A. H. Sommer, R. G. Stoudenheimer, F. R. Hughes, F. A. Helvy, J. J. Polkosky, and A. F. McDonie and are herein incorporated by reference. In such sensitization methods and techniques, vapors of a plurality of alkali metals are reacted with the base layer(s) of antimony to form the reaction product of antimony with the alkali metals of such vapors. In the activation of emitter 110, it is believed preferable that the entire thickness of the antimony layers 118 and 120 include the reaction products of antimony with at least one alkali metal.

Photocathode electrodes manufactured in the above manner may be incorporated within photomultipliers of the "side on" type in a manner well known in the art.

Figure 2:
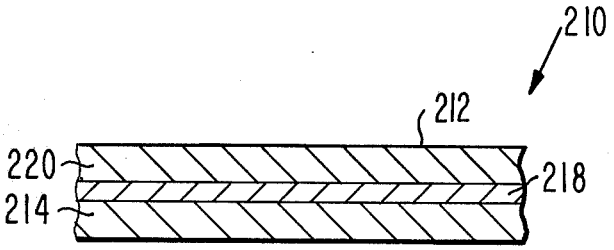
Figure 3:
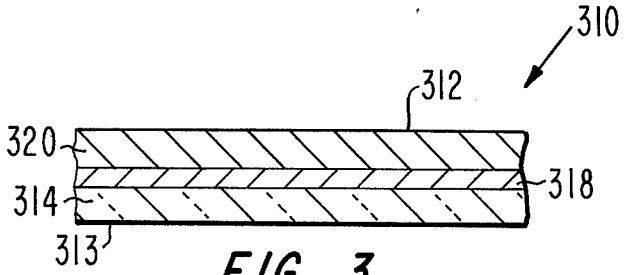

Referring to FIGS. 2 and 3, other embodiments of the invention are shown wherein similar numbers are employed in relation to FIG. 1 to designate corresponding elements of the structures depicted. In the embodiment of FIG. 2, the metal oxide layer is omitted. This structural arrangement may be employed whenever a substrate material is selected which does not substantially react with the antimony layers 218 or 220 (which correspond to the layers 118 and 120 of FIG. 1). Alternative substrate materials such as, for example, steel, aluminum and nichrome may be employed to advantage in such structural configurations.

In the embodiment of FIG. 3, there is shown an electron emitter 310 similar to that depicted in FIG. 2, however, formed along a glass supporting substrate 313.

It is believed that the emitters 110, 210 and 310 of FIGS. 1–3 may be employed to advantage in secondary emissive electrodes.

The electron emitter of the present invention having the porous antimony layer has the advantage over a similar electron emitter which does not have the porous antimony layer of improved sensitivity, particularly at long wavelengths.

I claim:

1. An electron emissive electrode comprising:

a. a base support member;

b. a solid layer of antimony disposed on said support member, said solid layer being less than about 1000 Angstroms thick and including the reaction products of antimony with at least one alkali metal; and c. a porous layer of antimony disposed on said solid layer, said porous layer being about 4 microns thick and including the reaction products of antimony with at least one alkali metal.

2. The electrode of claim 1 wherein said base support member comprises glass.

3. The electrode of claim 1 wherein said support member comprises a metal.

4. The electrode of claim 3 further comprising a metal oxide buffer film between said support member and said solid layer.

5. The electrode of claim 4 wherein said metal support member is composed of nickel, and said metal oxide is manganese oxide.

* * * * *